US007082902B2

(12) United States Patent
Lolli et al.

(10) Patent No.: US 7,082,902 B2
(45) Date of Patent: Aug. 1, 2006

(54) PUMP/VALVE ASSEMBLY AND A COOLING CIRCUIT CONTAINING SUCH AN ASSEMBLY

(75) Inventors: Sergio Lolli, Ascoli Piceno (IT); Richard Komurian, Turckheim (FR); Anthony Alves, Holtzwihr (FR)

(73) Assignee: Mark IV Systems Moteurs, Courbevoie (FR)

( * ) Notice: Subject to any disclaimer, the term of this patent is extended or adjusted under 35 U.S.C. 154(b) by 0 days.

(21) Appl. No.: 10/499,615

(22) PCT Filed: Dec. 20, 2002

(86) PCT No.: PCT/EP02/14673

§ 371 (c)(1),
(2), (4) Date: Nov. 18, 2004

(87) PCT Pub. No.: WO03/054365

PCT Pub. Date: Jul. 3, 2003

(65) Prior Publication Data

US 2005/0061268 A1 Mar. 24, 2005

(30) Foreign Application Priority Data

Dec. 21, 2001 (FR) ..... 01 16759

(51) Int. Cl.
*F01P 7/14* (2006.01)

(52) U.S. Cl. ..... 123/41.1; 123/41.15; 123/41.08; 123/41.44

(58) Field of Classification Search ..... 123/41.1, 123/41.15, 41.02, 41.08, 41.4, 41.44
See application file for complete search history.

(56) References Cited

U.S. PATENT DOCUMENTS

| | | | | |
|---|---|---|---|---|
| 6,164,248 | A | 12/2000 | Lehmann | |
| 6,745,995 | B1 * | 6/2004 | Hu et al. | 251/81 |
| 6,786,183 | B1 * | 9/2004 | Hoelle et al. | 123/41.44 |
| 2001/0054395 | A1 * | 12/2001 | Stephan et al. | 123/41.44 |
| 2004/0065275 | A1 * | 4/2004 | Hayami et al. | 123/41.1 |

FOREIGN PATENT DOCUMENTS

| | | | |
|---|---|---|---|
| DE | 40 33 261 | A1 | 4/1992 |
| DE | 199 33 794 | A1 | 2/2000 |
| EP | 0 371 225 | A2 | 6/1990 |
| EP | 0 969 190 | A1 | 1/2000 |

* cited by examiner

*Primary Examiner*—Tony M. Argenbright
*Assistant Examiner*—Katrina B. Harris
(74) *Attorney, Agent, or Firm*—Gottlieb, Rackman&Reisman

(57) ABSTRACT

A pump/valve assembly forming part of a circuit for circulating a liquid fluid has a pump and a proportional-control valve unit (2) in series with the pump. The valve unit (2) has a valve (3), an electrical actuator (4) and a position sensor (5) which are fixed to a movable member (3') sealing the valve (3) for displacement therewith, and control means (6) controlling the actuator (4) according to the position of the movable member (3') indicated by the sensor (5) and a reference signal. The valve unit (2) is subjected to a procedure indexing the position of the movable member (3') and setting parameters for the control means (6) at the beginning of each new operating cycle of the assembly, and the pump (1) is rotated at a constant speed selected from a limited number of predetermined speeds at least during part of each operating cycle.

11 Claims, 3 Drawing Sheets

PUMP/VALVE ASSEMBLY AND A COOLING CIRCUIT CONTAINING SUCH AN ASSEMBLY

TECHNICAL FIELD

The invention relates to the field of adjusted or controlled circulation of gaseous or liquid fluids in at least one circuit or length of pipe, and its subject is a pump/valve assembly and a cooling circuit including such an assembly.

BACKGROUND ART

A large number of devices for circulating a fluid in a circuit by controlling the flow rate with more or less precision are already known.

When relatively precise adjustment is required two solutions may be envisaged, namely adjusting the speed or power of the active member (the pump) by providing it with a converter or a drive which is continuously adjustable within the required ranges, or adding a flow-adjusting means with a movable element such as a valve or the like to an active element with limited or crude adjustment capacity (such as a pump operating at constant speed).

The first solution is relatively expensive owing to the type of motor and electronic control means needed for its use and the second solution, although less costly, often fails to provide the required precision in many applications, because the adjusting means used do not take the actual position of the movable element into account and/or do not allow for the physical changes affecting the mechanical parts of the devices.

In the latter case wear on the packing of the movable element and/or the contact surface of that element will lead to a shift in the fully-closed position of the adjusting device which will not be taken into account.

DISCLOSURE OF INVENTION

The object of the invention is to overcome the above disadvantages and to provide a high-precision adjusting assembly comprising a pump and at least one adjusting means at relatively low cost.

To this end its subject is an assembly forming part of a circuit for circulating a liquid fluid and comprising a pump and at least one valve unit with proportional control, in which the valve is mounted in series with said pump in that part of the circuit, characterised in that the valve unit comprises, apart from the valve itself, firstly an electrical actuator and a position sensor which are fixed to the movable member sealing the valve for displacement therewith, and secondly a control means controlling the actuator according to the position of the movable member indicated by the sensor and a reference signal, said valve unit being subjected to a procedure indexing the position of the movable member and setting parameters for the control means at the beginning of each new operating cycle of the assembly, and that the pump is rotated at a constant speed, if appropriate selected from a limited number of predetermined speeds, at least during part of each operating cycle of the pump.

BRIEF DESCRIPTION OF THE DRAWINGS

The invention will be understood better from the following description which relates to preferred embodiments given as non-restrictive examples. These will be explained with reference to the accompanying diagrammatic drawings, in which.

BEST MODE FOR CARRYING OUT THE INVENTION

The assembly as shown in the accompanying drawings comprises a pump 1 driven by a motor 1' and at least one valve unit 2 with proportional control, in which the valve 3 is mounted in series with said pump in the part of the circuit which receives and is at least partly formed by said pump 1/valve unit 2 assembly.

Figure 1:
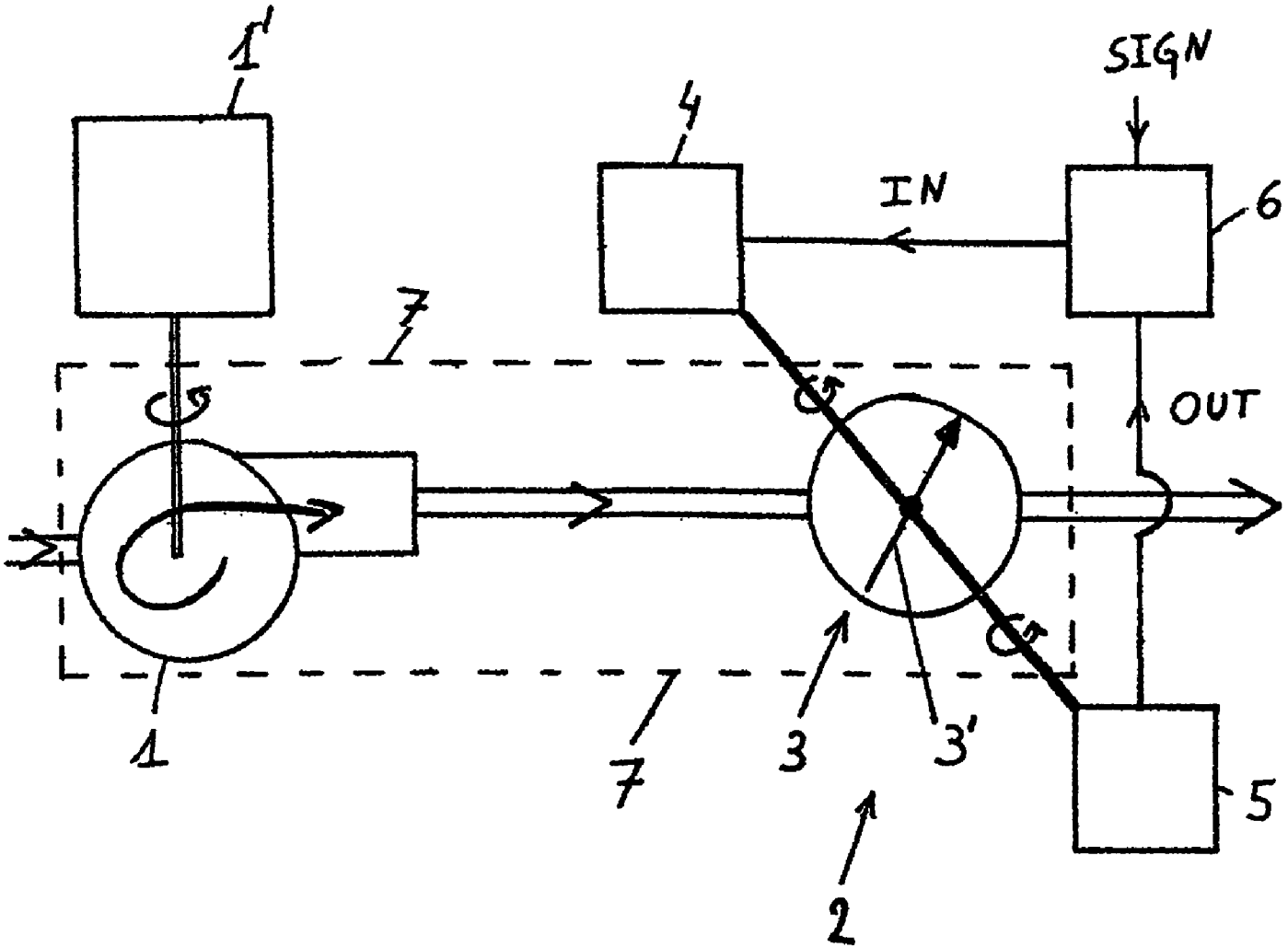
FIG. 1 is a diagrammatic representation of a first embodiment of an assembly according to the invention.

In accordance with the invention the valve unit comprises, apart from the valve 3 itself, firstly an electrical actuator 4 and a position sensor 5 which are fixed to the movable member 3' sealing the valve 3 for displacement therewith, and secondly a control means 6 controlling the actuator 4 according to the position of the movable member 3' indicated by the sensor 5 and a reference signal, said valve unit 2 being subjected to a procedure indexing the position of the movable member 3' and setting parameters for the control means 6 at the beginning of each new operating cycle of the assembly. The pump 1 is rotated at a constant speed, if appropriate selected from a limited number of predetermined speeds, at least during part of each operating cycle of the pump 1 (FIG. 1).

The valve unit 2 will preferably correspond to an adjusting device as described in French patent application No. 0116633 filed 21 Dec. 2001 in Applicants' name, and will advantageously be controlled by a method also described in that application. The full contents of that specification are included herein by reference.

One feature of the invention is that the pump 1 is rotated by an electric motor 1' with a constant speed or one which can operate at a plurality of predetermined fixed speeds. The prices of the motor 1' and its supply and control circuits will consequently be lower.

In a preferred embodiment of the invention the pump 1 and valve 3 are incorporated in one and the same structural module 7.

A modular, single-block construction of the pump 1/valve 3 assembly of this type, which can be produced in compact, rigid form at low cost and with resistance to vibration and impact, is described for example in French patent application No. 0013844 of 27 Oct. 2000 in the Applicants' name, and the contents of that application are included in this specification by reference.

The single-block structural module 7 advantageously comprises an intimate assembly of at least two parts made of a thermoplastic material, these parts in particular forming the casing of the pump 1 and the housing of the valve 3.

Figure 2:
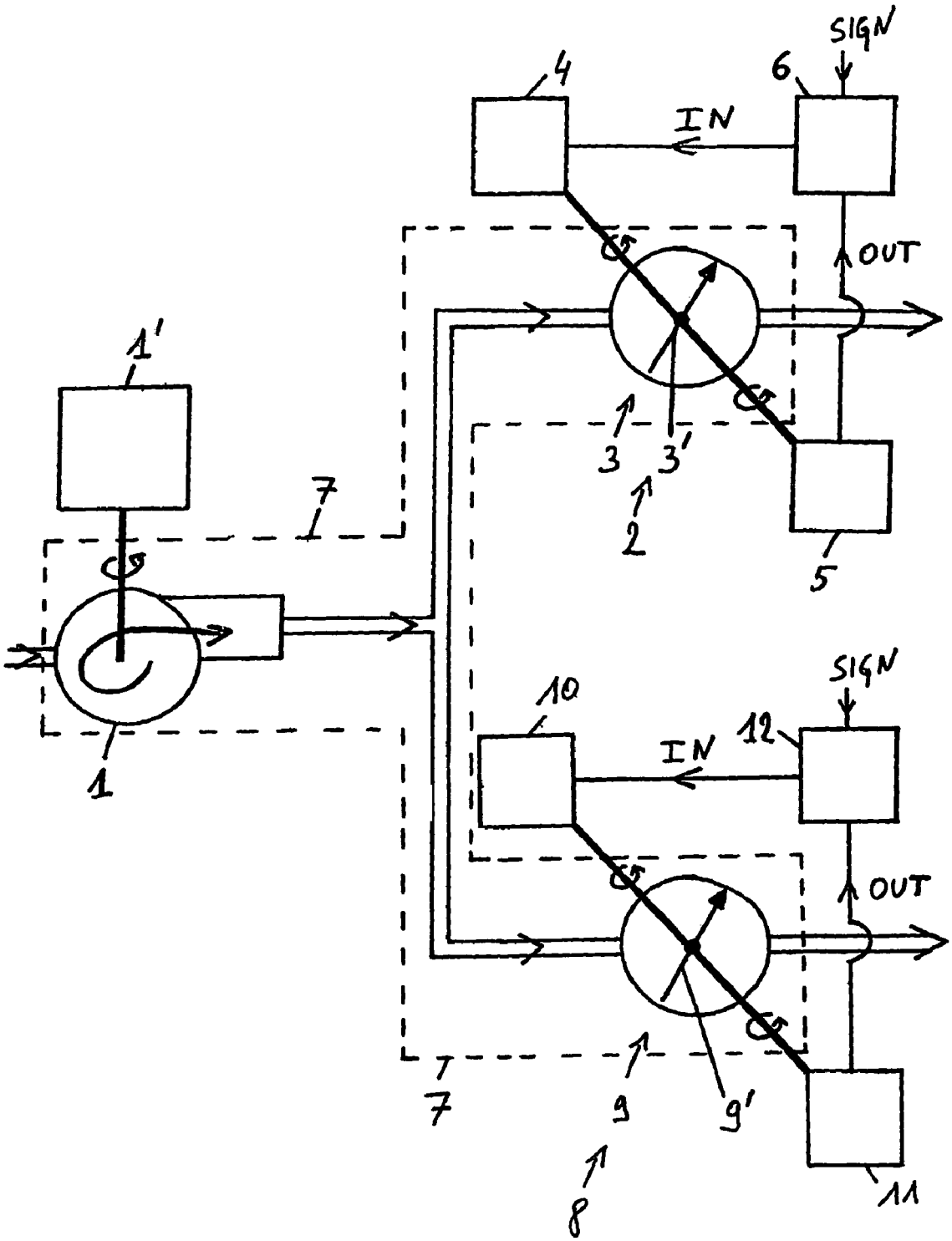
FIG. 2 is a diagrammatic representation of a second embodiment of an assembly according to the invention.

In an alternative embodiment of the invention shown in FIG. 2 of the accompanying drawings the assembly may further comprise at least a second valve unit 8 with proportional control, the valve 9 of which is similarly mounted in series with the pump 1 in respect of fluid flow but in parallel with the valve 3 of the first valve unit 2, the second valve unit 8 also comprising, apart from the valve 9 itself, firstly an electrical actuator 10 and a position sensor 11 which are fixed to the movable member 9' sealing said second valve 9 for displacement therewith, and secondly a control means 12 controlling the actuator 10 according to the position of the movable member 9' indicated by the sensor 11 and a reference signal, the unit similarly being subjected to an indexing and parameter-setting procedure at the beginning of each new operating cycle of the pump 1.

The second valve unit 8 will thus have a construction and mode of operation substantially similar to those of the first valve unit 2.

In order to optimise fluid circulation, use the power consumed by the motor 1' to the maximum and put the motor under a substantially constant load during its active periods in a given operating cycle, provision may advantageously be made for the first valve 3 and second valve 9 to be controlled so as to counteract each other, in such a way that the total resistance to the flow produced by the two valves 3 and 9 and their respective associated circuits (incorporating those valves) is substantially constant (a substantially constant sum of partial resistances).

As shown in FIG. 2 of the accompanying drawings the second valve 9 may also be an integral part of the structural module 7 containing the pump 1 and the first valve 3.

The movable member 3' of the first valve 3 and, if appropriate, the movable member 9' of the second valve 9 are preferably in the form of a butterfly valve or a rotary check valve mounted on a spindle.

Figure 3:
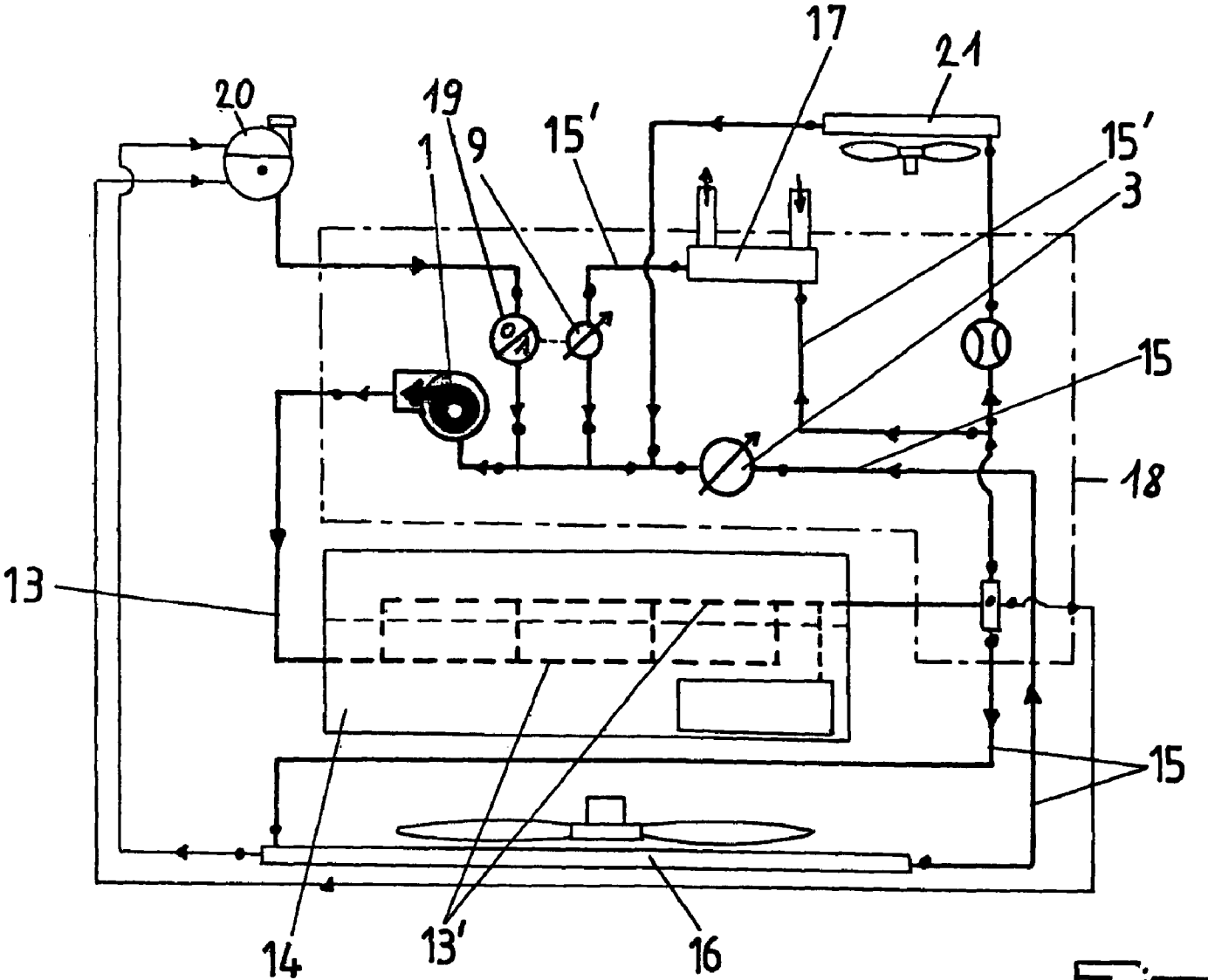
FIG. 3 is a functional fluid-flow diagram of a cooling circuit incorporating an assembly as shown in FIG. 2.

As shown by way of example in FIG. 3 of the accompanying drawings, the invention also concerns a thermal motor circuit of a vehicle, characterised in that it comprises an assembly as described above, with the pump 1 preferably directly supplying the circuit portion 13 including the means 13' for cooling the engine 14.

In a possible embodiment of the invention the circuit portion 13 including the means 13' for cooling the engine 14 leads into at least two shunt circuits, namely a shunt circuit 15 incorporating the radiator 16 and the first valve 3 and a shunt circuit 15' incorporating the heat exchanger 17 for the exhaust fumes and the second valve 9.

Finally, according to an additional feature of the invention, not only the pump 1 and valves 3 and 9 but also the heat exchanger 17, at least part of the circuit portion 13 and at least part of the shunt circuits 15 and 15' may make up an integral part and be formed by one and the same structural module 18, e.g. comprising an assembly of a plurality of parts made of a thermoplastic material.

A cooling circuit in this form is also described and illustrated in the above-mentioned French patent application No. 0013844.

A circuit of this type may equally include a shunt circuit containing an all-or-nothing valve 19 extending through the liquid and de-gassing tank 20 and another shunt circuit supplying the radiator 21 which heats the body. At least some of these additional members may also be incorporated in the single-block structural module 18 (see FIG. 3).

The invention is not of course restricted to the embodiments described and illustrated in the accompanying drawings. These may still be modified, particularly in respect of the structure of the various members or by substituting equivalent techniques, without thereby going beyond the scope of protection of the invention.

The invention claimed is:

1. An assembly forming part of a circuit for circulating a liquid fluid and comprising a pump and at least one valve unit with proportional control, in which the valve is mounted in series with said pump in that part of the circuit, characterized in that the valve unit (2) comprises, apart from the valve (3) itself, firstly an electrical actuator (4) and a position sensor (5) which are fixed to the movable member (3') sealing the valve (3) for displacement therewith, and secondly a control means (6) controlling the actuator (4) according to the position of the movable member (3') indicated by the sensor (5) and a reference signal, said valve unit (2) being subjected to a procedure indexing the position of the movable member (3') and setting parameters for the control means (6) at the beginning of each new operating cycle of the assembly, and that the pump (1) is rotated at a constant speed, if appropriately selected from a limited number of predetermined speeds, at least during part of each operating cycle of the pump (1).

2. The assembly of claim 1, characterized in that the pump (1) is rotated by an electric motor (1') with a constant speed or one which can operate at a plurality of predetermined fixed speeds.

3. The assembly of claim 1, characterized in that the pump (1) and valve (3) are incorporated in one and the same structural module (7).

4. The assembly of claim 3, characterized in that the single-block structural module (7) comprises an intimate assembly of at least two parts made of a thermoplastic material, these parts in particular forming the casing of the pump (1) and the housing of the valve (3).

5. The assembly of claim 1, characterized in that it comprises at least a second valve unit (8) with proportional control, the valve (9) of which is similarly mounted in series with the pump (1) in respect of fluid flow but in parallel with the valve (3) of the first valve unit (2), the second valve unit (8) also comprising, apart from the valve (9) itself, firstly an electrical actuator (10) and a second valve (9) for displacement therewith, and secondly a control means (12) controlling the actuator (10) according to the position of the movable member (9') indicated by the sensor (11) and a reference signal, the unit similarly being subjected to an indexing and parameter-setting procedure at the beginning of each new operating cycle of the pump (1).

6. The assembly of claim 5, characterized in that the first valve (3) and second valve (9) are controlled so as to a counteract each other, in such a way that the total resistance to the flow produced by the two valves (3) and (9) and their respective associate circuits is substantially constant.

7. The assembly of claim 5 insofar as they are appended to claim 3 or 4, characterized in that the second valve (9) is also an integral part of the structural module (7) containing the pump (1) and the first valve (3).

8. The assembly of claim 1, characterized in that the movable member (3') of the first valve (3) and, if appropriate, the movable member (9') of the second valve (9) are in the form of a butterfly valve or a rotary check valve mounted on a spindle.

9. A circuit for cooling a thermal engine of a vehicle, characterized in that it comprises an assembly according to claim 1, with the pump (1) preferably directly supplying the circuit portion (13) including the means (13') for cooling the engine (14).

10. The circuit of claim 9, characterized in that the circuit portion (13) including the means (13') for cooling the engine (14) leads into at least two shunt circuits, namely a shunt circuit (15) incorporating the radiator (16) and the first valve (3) and a shunt circuit (15') incorporating the heat exchanger (17) for the exhaust fumes and the second valve (9).

11. The circuit of claim 10, characterized in that not only the pump (1) and valves (3 and 9) but also the heat exchanger (17), at least part of the circuit portion (13) and at least part of the shunt circuits (15 and 15') make up an integral part and are formed by one and the same structural module (18), for example comprising an assembly of a plurality of parts made of a thermoplastic material.

* * * * *

UNITED STATES PATENT AND TRADEMARK OFFICE

CERTIFICATE OF CORRECTION

PATENT NO. : 7,082,902 B2
APPLICATION NO. : 10/499615
DATED : August 1, 2006
INVENTOR(S) : Sergio Lolli, Richard Komurian and Anthony Alves It is certified that error appears in the above-identified patent and that said Letters Patent is hereby corrected as shown below:

On Title Page item 73 should read
Assignee: Mark IV Systemes Moteurs S.A.
Courbevoie (FR)

Signed and Sealed this

Thirtieth Day of January, 2007

JON W. DUDAS
*Director of the United States Patent and Trademark Office*